US008635884B2

(12) United States Patent
Hirayama

(10) Patent No.: US 8,635,884 B2
(45) Date of Patent: Jan. 28, 2014

(54) MULTI-CYLINDER ROTARY COMPRESSOR AND REFRIGERATION CYCLE APPARATUS

(75) Inventor: Takuya Hirayama, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 133 days.

(21) Appl. No.: 13/416,687

(22) Filed: Mar. 9, 2012

(65) Prior Publication Data

US 2012/0260691 A1 Oct. 18, 2012

Related U.S. Application Data

(63) Continuation of application No. PCT/JP2010/065471, filed on Sep. 9, 2010.

(30) Foreign Application Priority Data

Sep. 11, 2009 (JP) ..... 2009-211100

(51) Int. Cl.
*F25B 1/00* (2006.01)

(52) U.S. Cl.
USPC ..... 62/498; 62/508

(58) Field of Classification Search
USPC ..... 62/470, 498, 508; 417/410.3; 418/29, 418/30, 59, 60
See application file for complete search history.

(56) References Cited

U.S. PATENT DOCUMENTS

| | | | | |
|---|---|---|---|---|
| 7,563,084 | B2 * | 7/2009 | Kurita et al. | 418/29 |
| 7,607,902 | B2 * | 10/2009 | Onoda | 418/23 |
| 2008/0112831 | A1 | 5/2008 | Ogasawara | |

FOREIGN PATENT DOCUMENTS

| | | |
|---|---|---|
| CN | 1356476 | 7/2003 |
| CN | 1456813 | 11/2003 |
| JP | 55-48887 | 11/1980 |
| JP | 62-195689 | 12/1987 |
| JP | 7-37796 | 4/1995 |
| JP | 2000-087888 | 3/2000 |
| JP | 2001-099083 | 4/2001 |
| JP | 2002-138978 | 5/2002 |
| JP | 2003-328972 | 11/2003 |
| JP | 2004-225578 | 8/2004 |
| JP | 2006-169978 | 6/2006 |
| JP | 2006-300048 | 11/2006 |
| JP | 2009-235985 | 10/2009 |
| KR | 2002-0034883 | 5/2002 |

OTHER PUBLICATIONS

International Search Report issued in PCT/JP2008/065461 dated Nov. 25, 2008.
English Language Abstract of JP 2003-328972 Published Nov. 19, 2003.

(Continued)

*Primary Examiner* — Melvin Jones
(74) *Attorney, Agent, or Firm* — DLA Piper LLP (US)

(57) ABSTRACT

A compression mechanism units include cylinder chambers into which a low-pressure gas is introduced, vanes contained in a vane groove, and a spring body that always causes compression operation in the cylinder chambers by providing an elastic force to a rear-end portion of one of the vanes, includes a pressure switching mechanism that switches to perform compression operation by guiding a high-pressure gas/not to perform the compression operation by guiding a low-pressure gas, is provided with a lubricating oil communication path communicatively connecting a oiling groove and a oil stagnant portion, and opposing the oiling groove to a portion other than the lubricating oil communication path when the vanes are in a top dead center position.

5 Claims, 4 Drawing Sheets

(56) References Cited

OTHER PUBLICATIONS

Machine English Language Translation of JP 2003-328972 Published Nov. 19, 2003.
English Language Abstract of JP 55-048887 Published Apr. 8, 1980.
English Language Abstract of JP 2002-138978 Published May 17, 2002.
Machine English Language Translation of JP 2002-138978 Published May 17, 2002.
English Language Abstract of CN Publication CN 1356476 published Jul. 3, 2002.
International Preliminary Report on Patentability issued in PCT/JP2008/065461 on Apr. 8, 2010.
Related U.S. Appl. No. 12/712,780.
English Language Abstract of JP 2000-087888 published Mar. 28, 2000.
English Language Translation of JP 2000-087888 published Mar. 28, 2000.
English Language Abstract of JP 2001-099083 published on Apr. 10, 2001.
English Language Translation of JP 2001-099083 published on Apr. 10, 2001.
International Search Report issued in PCT/JP2010/065471 mailed on Dec. 14, 2010.
English Language Abstract of JP 2006-169978 published on Jun. 29, 2006.
English Language Translation of JP 2006-169978 published on Jun. 29, 2006.
English Language Abstract of JP 2009-235985 published on Oct. 15, 2009.
English Language Translation of JP 2009-235985 published on Oct. 15, 2009.
English Language Abstract of JP 7-37796 published Apr. 26, 1995.
English Language Translation of JP 7-37796 published Apr. 26, 1995.
English Language Abstract of JP 2004-225578 published Aug. 12, 2004.
English Language Translation of JP 2004-225578 published Aug. 12, 2004.
English Language Abstract of JP 2006-300048 published Nov. 2, 2006.
English Language Translation of JP 2006-300048 published Nov. 2, 2006.
International Preliminary Report on Patentability issued in PCT/JP2010/065471 mailed on Apr. 19, 2012.

* cited by examiner

MULTI-CYLINDER ROTARY COMPRESSOR AND REFRIGERATION CYCLE APPARATUS

CROSS REFERENCE TO RELATED APPLICATIONS

This application is a Continuation Application of PCT Application No. PCT/JP2010/065471, filed Sep. 9, 2010 and based upon and claiming the benefit of priority from prior Japanese Patent Application No. 2009-211100, filed Sep. 11, 2009, the entire contents of all of which are incorporated herein by reference.

BACKGROUND OF THE INVENTION

1. Field of the Invention

The present invention relates to a multi-cylinder rotary compressor capable of switching compression capacities and a refrigeration cycle apparatus that configures a refrigeration cycle by including the multi-cylinder rotary compressor.

2. Description of the Related Art

In a refrigeration cycle apparatus, multi-cylinder rotary compressors including a plurality of cylinder chambers (mainly two) in a compression mechanism unit are frequently used. Such a kind of compressor is advantageous if it is possible to carry out switching between the so-called full-capacity operation and capacity reduced operation in which compression operation is performed in a plurality of cylinder chambers simultaneously or compression operation is reduced by stopping the compression operation in one cylinder chamber respectively.

Jpn. Pat. Appln. KOKAI Publication No. 2006-300048 discloses a compressor including a first cylinder and a second cylinder, wherein suction pressure is guided into the cylinder chamber of the first cylinder and suction pressure or discharge pressure is guided into the cylinder chamber of the second cylinder. The first cylinder includes a vane chamber containing a rear-side end of a vane and a spring member and the second cylinder includes a vane chamber that contains the rear-side end of the vane and is sealed.

Then, suction pressure or discharge pressure is guided into the second vane chamber to energize pressing of the vane in accordance with a differential pressure between the suction pressure and the discharge pressure guided into the second cylinder chamber. Thus, an enclosed compressor capable of switching between the full-capacity operation that performs compression operation by using both cylinder chambers and the capacity reduced operation in which the compression operation is not performed in the second cylinder chamber is disclosed.

The second vane chamber described above has a sealed structure and thus, a sliding contact surface between a vane groove communicatively connecting to the vane chamber of the second cylinder and both side surfaces of the vane reciprocating in the vane groove needs oiling. Thus, according to the above technology, an oil groove to introduce lubricating oil into the vane groove is provided and also an oil communication hole is included in a sub-bearing.

BRIEF SUMMARY OF THE INVENTION

In the above enclosed compressor, an oil stagnant portion of lubricating oil is formed at an inner bottom of a well-closed container and almost all of a compression mechanism unit is soaked in the lubricating oil. The oil communication hole is open to the oil stagnant portion and lubricating oil is guided to the oil groove via the oil communication hole to oil the sliding contact surface between the vane groove and the vane. If the second vane chamber has a sealed structure, smoothness is ensured for reciprocating movement of the vane.

On the other hand, however, lubricating oil in the oil stagnant portion is constantly guided from the oil communication hole to the oil groove regardless of whether compression operation is performed or a resting cylinder operation is performed in the second cylinder chamber. While smoothness of the vane is ensured as described above when the vane reciprocates, oiling will continue during resting cylinder operation in which the vane does not move.

In this state, the lubricating oil is leaked to the lower-pressure second vane chamber from a clearance between the vane and the vane groove and the second vane chamber is filled with the lubricating oil if the quantity of leakage is large. If the full-capacity operation is switched to the compression operation in this state, the rear-side end of the vane needs to reciprocate in the lubricating oil in the second vane chamber, leading to lower compression performance due to lack of smoothness of movement.

Further, according to Jpn. Pat. Appln. KOKAI Publication No. 2006-300048, an oil groove in a substantially semicircular shape in the plane view is notched in a vane groove configured by side surfaces parallel to and opposite each other. An oil groove is normally obtained by broaching, but if an oil groove is additionally worked on after a vane groove is worked on, the vane groove may be deformed or burrs, protrusions or the like arises while the vane groove is worked on, leading to lower performance/reliability due to degraded precision of the width of the vane groove.

Working on a vane groove after an oil groove in a circular shape is provided can be considered, but a worked portion and a non-worked portion arise in a broach blade due to the presence of the oil groove. The shape of the broach blade is thereby deformed, leading to decreased machining accuracy and an extremely shorter life of the broach blade.

The present invention is made in view of the above circumstances and an object thereof is to provide a multi-cylinder rotary compressor capable of providing high compression performance by ensuring smoothness of reciprocating movement of the vane on the side of performing a resting cylinder operation on the assumption that the multi-cylinder rotary compressor includes two cylinders and the compression capacity can be switched and a refrigeration cycle apparatus capable of improving the efficiency of the refrigeration cycle by including the multi-cylinder rotary compressor.

To achieve the above object, a multi-cylinder rotary compressor according to the present invention contains an electric motor unit and a compression mechanism unit in a well-closed container and causes lubricating oil to stagnate at the bottom of the well-closed container.

In the compression mechanism unit, a first cylinder and a second cylinder are provided with an intermediate partition plate placed therebetween, a cylinder chamber to introduce a low-pressure gas into an inner diameter portion of each cylinder is formed, and a vane rear chamber communicatively connected to these cylinder chambers via a vane groove is provided.

An axis of rotation coupled to the electric motor unit has an eccentric portion contained in each cylinder chamber and an eccentric roller that eccentrically moves inside the cylinder chamber with the rotation of the axis of rotation is fitted to the eccentric portion to partition the cylinder chamber while a tip portion of the vane is in contact with a circumferential wall of the eccentric roller.

One of the vane rear chambers provided in the first cylinder and the second cylinder includes an elastic body that brings the tip portion of the vane into contact with the circumferential wall of the eccentric roller by providing an elastic force to a rear-end portion of the vane to constantly cause compression operation in the cylinder chamber with the rotation of the axis of rotation.

The other vane rear chamber has a sealed structure and includes a pressure switching unit that causes compression operation in the cylinder chamber with the rotation of the axis of rotation by guiding a portion of the high-pressure gas to provide high-pressure back pressure to the rear-end portion of the vane to bring the tip portion of the vane into contact with the circumferential wall of the eccentric roller or holds the tip portion of the vane separated from the circumferential wall of the eccentric roller by guiding a low-pressure gas to provide low-pressure back pressure to the rear-end portion of the vane.

An oiling groove is provided on the side surface of the vane, a lubricating oil communication path that guides oiling of lubricating oil in the oil stagnant portion to the oiling groove is provided in the compression mechanism unit, and the oiling groove is opposite to a portion other than the lubricating oil communication path when the tip portion of the vane is in a top dead center position where the tip portion dips most from the cylinder chamber so that the oiling groove is not communicatively connected to the lubricating oil communication path.

To achieve the above object, a refrigeration cycle apparatus constitutes a refrigeration cycle by including the above multi-cylinder rotary compressor, a condenser, an expansion apparatus, and an evaporator.

DETAILED DESCRIPTION OF THE INVENTION

An embodiment of the present invention will be described below based on drawings.

Figure 1:
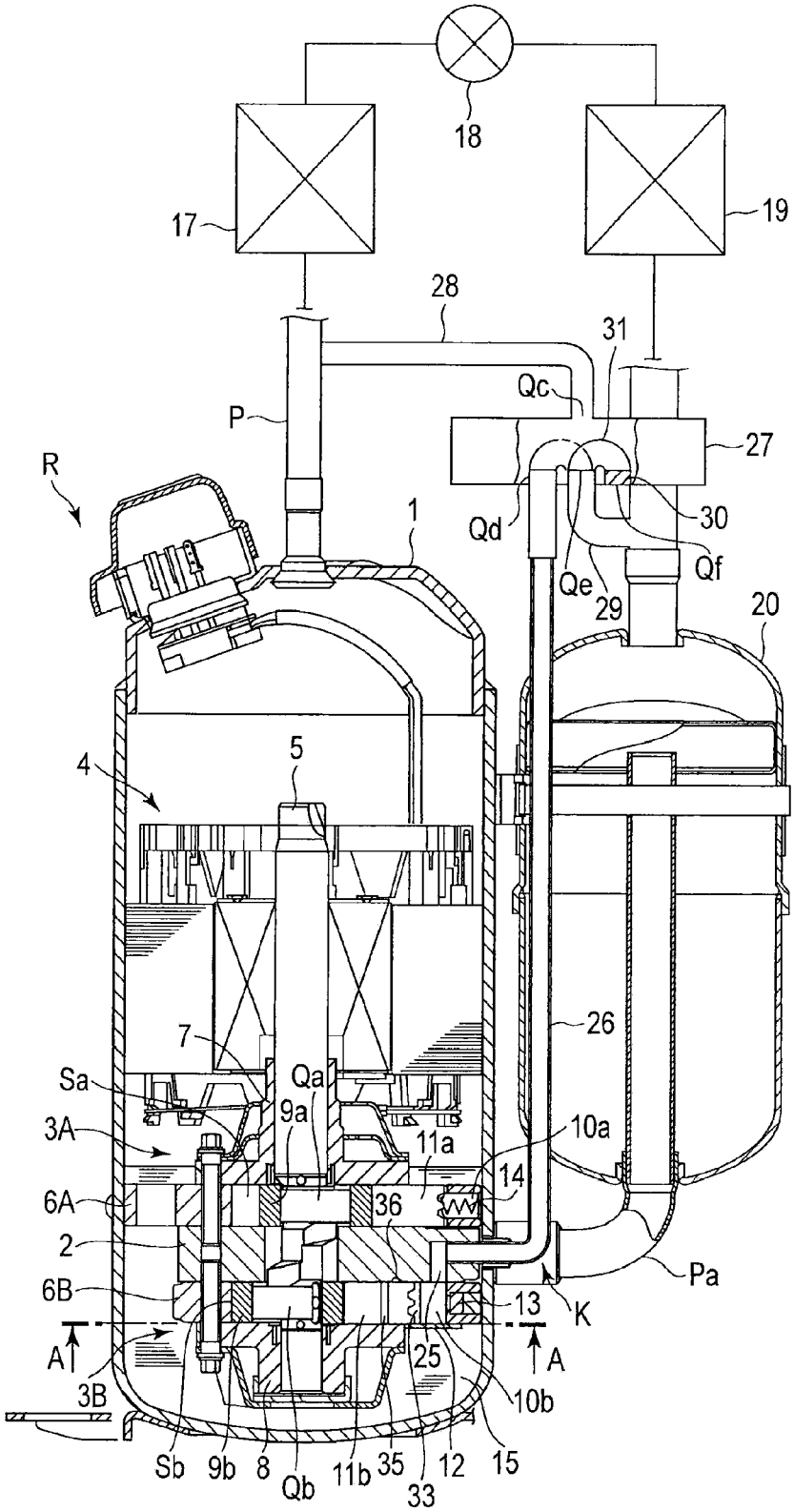
FIG. 1 is a longitudinal sectional view of an outline multi-cylinder rotary compressor according to an embodiment of the present invention and a refrigeration cycle block diagram of a refrigeration cycle apparatus.
Figure 2:
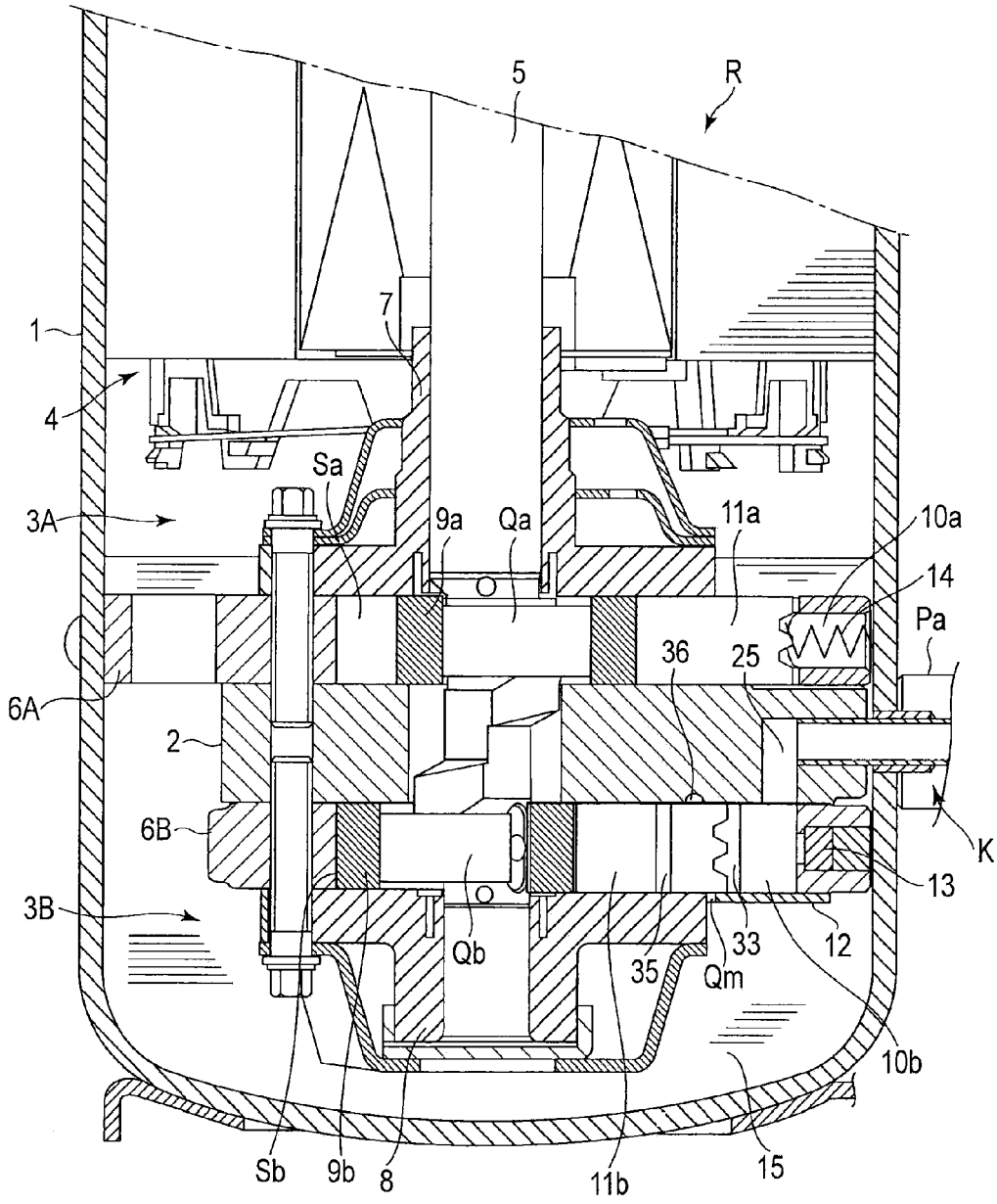
FIG. 2 is a longitudinal sectional view showing the multi-cylinder rotary compressor according to the embodiment by enlarging a portion thereof.

FIG. 1 shows a section structure of an outline multi-cylinder rotary compressor R and a refrigeration cycle configuration of a refrigeration cycle apparatus including the multi-cylinder rotary compressor R. FIG. 2 is a longitudinal sectional view showing the multi-cylinder rotary compressor R by enlarging a portion thereof (some parts have, though described, no reference number attached thereto to avoid complicatedness of drawings and this also applies below).

First, the multi-cylinder rotary compressor R will be described. Reference number 1 is a well-closed container and a first compression mechanism unit 3A and a second compression mechanism unit 3B are provided in a lower part of the well-closed container 1 via an intermediate partition plate 2 and an electric motor unit 4 is provided in an upper part thereof. These first compression mechanism unit 3A and second compression mechanism unit 3B are coupled to the electric motor unit 4 via an axis of rotation 5.

The first compression mechanism unit 3A includes a first cylinder 6A and the second compression mechanism unit 3B includes a second cylinder 6B. A main bearing 7 is mounted and fixed to an upper surface portion of the first cylinder 6A and a sub-bearing 8 is mounted and fixed to an undersurface portion of the second cylinder 6B. The axis of rotation 5 passes through the cylinders 6A, 6B and integrally includes a first eccentric portion Qa and a second eccentric portion Qb formed with a phase difference of about 180°.

The eccentric portions Qa, Qb form the mutually the same diameter and are assembled so as to be positioned in an inner diameter portion of the cylinders 6A, 6B respectively. A first eccentric roller 9*a* is fitted to a circumferential surface of the first eccentric portion Qa and a second eccentric roller 9*b* is fitted to the circumferential surface of the second eccentric portion Qb.

A first cylinder chamber Sa is formed in the inner diameter portion of the first cylinder 6A and a second cylinder chamber Sb is formed in the inner diameter portion of the second cylinder 6B. The cylinder chambers Sa, Sb are formed to mutually the same diameter and height dimensions and a portion of the circumferential wall of each of the eccentric rollers 9*a*, 9*b* is freely eccentrically rotatably contained therein while being linearly in contact with a portion of the circumferential wall of each of the cylinder chambers Sa, Sb, respectively.

A first vane rear chamber 10*a* communicatively connected to the first cylinder chamber Sa via a vane groove is provided in the first cylinder 6A and a first vane 11*a* is freely movably contained in the vane groove.

A second vane rear chamber 10*b* communicatively connected to the second cylinder chamber Sb via a vane groove is provided in the second cylinder 6B and a second vane 11*b* is freely movably contained in the vane groove.

The tip portion of the first and second vanes 11*a*, 11*b* is formed in a substantially arc shape in plane view and can protrude into the opposite cylinder chambers Sa, Sb. In this state, the tip portion of the vanes 11*a*, 11*b* is linearly in contact with the circumferential wall of the first and second eccentric rollers 9*a*, 9*b* in a circular shape in plane view regardless of the angle of rotation.

A lateral hole communicatively connecting the first vane rear chamber 10*a* and an outer circumferential surface of the first cylinder 6A is provided in the first cylinder 6A and a spring member 14 as an elastic body is contained therein. The spring member 14 is placed between an end surface of the rear-end portion of the first vane 11*a* and an inner circumferential wall of the well-closed container 1 to provide an elastic force (back pressure) to the vane 11*a*.

The second vane rear chamber 10*b* in the second cylinder 6B is provided in a position protruding in an outer direction from a circumferential edge of a flange of the sub-bearing 8 and an upper surface and an undersurface thereof are open as they are and are opened into the well-closed container 1. Here, the upper surface opening is blocked by the intermediate partition plate 2 and the undersurface opening is blocked by a blocking plate 12 so that the second vane rear chamber 10*b* forms a sealed structure.

A lateral hole communicatively connecting the second vane rear chamber 10*b* and the outer circumferential surface of the second cylinder 6B is provided and a permanent magnet 13 is mounted. When the rear-end portion of the second vane 11*b* comes into contact, the permanent magnet 13 has a magnetic force to magnetically adsorb the rear-end portion.

In this state, the tip portion of the second vane 11*b* dips below the circumferential wall of the second cylinder chamber Sb so that even if the second eccentric roller 9*b* moves toward the tip portion, the tip portion of the vane 11*b* is positioned separated from the circumferential wall of the roller 9*b*.

The intermediate partition plate 2 is mounted with a pressure switching mechanism (pressure switching unit) K described later. A high-pressure gas (discharge pressure) or a low-pressure gas (suction pressure) can be guided into the second vane rear chamber 10*b* in accordance with a switching operation of a pressure switching mechanism K to switch the back pressure for the rear-end portion of the second vane 11*b*.

An oil stagnant portion 15 to stagnate lubricating oil is formed at an inner bottom of the well-closed container 1. In FIG. 1, the solid line crossing the flange portion of the main bearing 7 indicates an oil level of the lubricating oil and almost all of the first compression mechanism unit 3A and all the second compression mechanism unit 3B are soaked in lubricating oil of the oil stagnant portion 15.

The second vane rear chamber 10*b* described above has a sealed structure and thus, the lubricating oil in the oil stagnant portion 15 does not penetrate into the vane rear chamber 10*b* even if the second vane 11*b* reciprocates, but as will be described later, oiling of the lubricating oil of the sliding contact surface between the second vane 11*b* and the vane groove is ensured.

The multi-cylinder rotary compressor R is configured as described above and a discharge pipe P is connected to an upper-end portion of the well-closed container 1. The discharge pipe P is connected to the upper-end portion of an accumulator 20 via a condenser 17, an expansion apparatus 18, and an evaporator 19. The accumulator 20 and the multi-cylinder rotary compressor R are connected via a suction pipe Pa.

Though not specifically illustrated, the suction pipe Pa passes through the well-closed container 1 constituting the multi-cylinder rotary compressor R to connect to a circumferential end surface of the intermediate partition plate 2. In the intermediate partition plate 2, a suction guiding path is provided from a circumferential surface portion to which the suction pipe Pa is connected toward the direction of an axial center. The tip of the suction guiding path is branched in two directions of obliquely upward and obliquely downward.

The branch guiding path branched obliquely upward is communicatively connected to the first cylinder chamber Sa. The branch guiding path branched obliquely downward is communicatively connected to the second cylinder chamber Sb. Thus, the accumulator 20 and the first cylinder chamber Sa and the second cylinder chamber Sb in the multi-cylinder rotary compressor R are always in a communicating state.

A refrigeration cycle apparatus is configured by sequentially connecting the multi-cylinder rotary compressor R, the condenser 17, the expansion apparatus 18, the evaporator 19, and the accumulator 20 described above through a pipe.

Next, the pressure switching mechanism K will be described in detail.

The intermediate partition plate 2 is provided with a curved pressure guiding path 25 extending from the circumferential end surface toward the direction of the axial center and also from the tip thereof to the undersurface in the direction directly below. One end of the pressure guiding path 25 open to the undersurface of the intermediate partition plate 2 is communicatively connected to the second vane rear chamber 10*b* provided in the second cylinder 6B.

An end of a guiding pipe 26 provided by being passed through the well-closed container 1 is fitted to the other end of the pressure guiding path 25 open to the circumferential surface of the intermediate partition plate 2 so as to avoid gas leakage. The guiding pipe 26 is formed rising along a sidewall of the well-closed container 1 and is connected to a second port Qd of a four-way switching valve 27 provided above the upper-end portions of the well-closed container 1 and the accumulator 20.

A first branch pipe 28 branched from an intermediate portion of the discharge pipe P communicatively connecting the well-closed container 1 and the condenser 17 is connected to a first port Qc of the four-way switching valve 27. A second branch pipe 29 communicatively connecting the evaporator 19 and the accumulator 20 is connected to a third port Qe. A fourth port Qf is blocked by a plug 30.

A valve body 31 contained in the four-way switching valve 27 and magnetically operated to switch can be switched to, as shown in FIG. 1, the position communicatively connecting the third port Qe and the fourth port Qf and, as indicated by a chain double-dashed line, the position communicatively connecting the second port Qd and the third port Qe. In contrast, the first port Qc is always opened and the fourth port Qf is always blocked by the plug 30.

Thus, in the state of FIG. 1, the first port Qc and the second port Qd are communicatively connected and the third port Qe and the fourth port Qf are communicatively connected by the valve body 31. However, the fourth port Qf is always blocked by the plug 30 and thus, only the communicative connection between the first port Qc and the second port Qd remains.

If the valve body 31 moves to the position indicated by the chain double-dashed line in FIG. 1, the first port Qc and the fourth port Qf are communicatively connected and the second port Qd and the third port Qe are communicatively connected by the valve body 31. Similarly, the fourth port Qf is blocked by the plug 30 and thus, only the communicative connection between the second port Qd and the third port Qe remains.

In the multi-cylinder rotary compressor R including the pressure switching mechanism K and a refrigeration cycle apparatus including the compressor R as described above, the capacity reduced operation (resting cylinder operation) and the full-capacity operation (normal operation) can be selected to switch by the operation of the pressure switching mechanism K.

If the capacity reduced operation is selected, the valve body 31 of the four-way switching valve 27 constituting the pressure switching mechanism K is switched to the position indicated by the chain double-dashed line in FIG. 1 so that the second port Qd and the third port Qe are communicatively connected. Thus, the evaporator 19 is communicatively connected to the guiding pipe 26 via the second branch pipe 29 and the four-way switching valve 27 and further communicatively connected to the second vane rear chamber 10B via the pressure guiding path 25.

At the same time, an operation signal is sent to the electric motor unit 4 and the axis of rotation 5 is driven to rotate so that the first and second eccentric rollers 9*a*, 9*b* eccentrically rotate in the respective cylinder chambers Sa, Sb. The vane 11*a* is pressed and energized by the spring member 14 in the first cylinder 6A and a tip edge thereof slidingly comes into contact with the circumferential wall of the eccentric roller 9*a* to divide the first cylinder chamber Sa into two portions.

A low-pressure refrigerant gas is guided from the accumulator 20 to the suction pipe Pa and drawn into the first cylinder chamber Sa and the second cylinder chamber Sb via the suction guiding path and branch guiding path.

A portion of the low-pressure refrigerant gas derived from the evaporator 19 is guided from the second branch pipe 29 to the guiding pipe 26 by the pressure switching mechanism K via the four-way switching valve 27. Then, the low-pressure refrigerant gas is guided into the second vane rear chamber 10*b* to be filled therewith via the pressure guiding path 25 provided in the intermediate partition plate 2.

The tip portion of the second vane 11*b* opposite to the second cylinder chamber Sb is in a low-pressure atmosphere and the rear-end portion of the second vane 11*b* opposite to the second vane rear chamber 10*b* is also in a low-pressure atmosphere so that no differential pressure arises between the tip portion and the rear-end portion of the vane 11*b*.

If the second eccentric roller 9*b* eccentrically moves with the rotation of the axis of rotation 5, the rear-end portion of the second vane 11*b* comes into contact with the permanent magnet 13 after being kicked by the second eccentric roller 9*b* and then does not move by being magnetically adsorbed. Therefore, no compression operation is performed in the second cylinder chamber Sb.

In the first cylinder chamber Sa, on the other hand, the first vane 11*a* receives an elastic force of the spring member 14 and the tip portion thereof comes into contact with the circumferential surface of the first eccentric roller 9*a* to divide the first cylinder chamber Sa into two portions. The volume of one of the partitioned portions of the cylinder chamber Sa decreases with the eccentric movement of the eccentric roller 9*a* and the drawn gas is gradually compressed.

If the gas reaches a predetermined pressure, a discharge valve mechanism is opened and the gas is once discharged to a discharge muffler and then guided into the well-closed container 1 to be filled therewith. Then, the high-pressure gas is guided from the discharge pipe P into the condenser 17, where the gas is condensed into a liquid refrigerant. The liquid refrigerant is guided into the expansion apparatus 18 for adiabatic expansion and evaporated in the evaporator 19 while evaporative latent heat is taken away from the air circulating through the evaporator 19.

The gaseous refrigerant made lower in pressure due to evaporation by the evaporator 19 is guided into the accumulator 20 for gas-liquid separation and the separated gaseous refrigerant is guided from the accumulator 20 into the first cylinder chamber Sa and the second cylinder chamber Sb via the suction pipe Pa to configure the above refrigeration cycle.

The capacity reduced operation will be performed by the resting cylinder operation being performed by the second cylinder chamber Sb because no compression operation is performed and the compression operation being performed by the first cylinder chamber Sa only.

If the full-capacity operation is selected, the valve body 31 of the four-way switching valve 27 is moved to be switched to the position shown in FIG. 1 and the first port Qc and the second port Qd are communicatively connected. Thus, the discharge pipe P and the first branch pipe 28 connected to the multi-cylinder rotary compressor R are communicatively connected to the guiding pipe 26 via the four-way switching valve 27 and communicatively connected to the second vane rear chamber 10*b* via the pressure guiding path 25.

At the same time, an operation signal is sent to the electric motor unit 4 and the axis of rotation 5 is driven to rotate so that the first and second eccentric rollers 9*a*, 9*b* eccentrically rotate in the respective cylinder chambers Sa, Sb. The vane 11*a* is pressed and energized by the spring member 14 in the first cylinder 6A and a tip edge thereof slidingly comes into contact with the circumferential wall of the eccentric roller 9*a* to divide the first cylinder chamber Sa into two portions.

A low-pressure refrigerant gas is guided from the accumulator 20 to a suction pipe Pb and drawn into the first cylinder chamber Sa and the second cylinder chamber Sb to be filled therewith via the suction guiding path and branch guiding path. In the first cylinder chamber Sa, compression operation is performed as described above and the well-closed container 1 is filled with a high-pressure gas.

While the high-pressure refrigerant gas filling the well-closed container 1 is discharged into the discharge pipe P to circulate in the above refrigeration cycle, a portion of the high-pressure gas is guided from the first branch pipe 28 to the guiding pipe 26 via the four-way switching valve 27. Then, the high-pressure gas is guided from the guiding pipe 26 into the second vane rear chamber 10*b* to be filled therewith via the pressure guiding path 25.

While the tip portion of the second vane 11*b* is in a low-pressure atmosphere opposite to the second cylinder chamber Sb, the rear-end portion thereof is in a high-pressure atmosphere opposite to the second vane 11*b* and thus, a differential pressure arises between the tip portion and the rear-end portion thereof. The rear-end portion is in the high-pressure atmosphere and thus, the vane 11*b* is pressed and energized to the side of the tip portion.

If the second eccentric roller 9*b* eccentrically moves with the rotation of the axis of rotation 5, the second vane 11*b* reciprocates in the second vane rear chamber 10*b* while being in contact with the circumferential surface of the second eccentric roller 9*b*. The second vane 11*b* divides the second cylinder chamber Sb into two portions and thus, compression operation is performed.

Therefore, the compression operation is performed simultaneously in the first cylinder chamber Sa and the second cylinder chamber Sb to perform the full-capacity operation.

By adopting a completely sealed structure for the second vane rear chamber 10*b* on the side on which a resting cylinder operation is performed in the above multi-cylinder rotary compressor R, it becomes necessary to ensure lubricity of the second vane 11*b* reciprocating.

Figure 3:
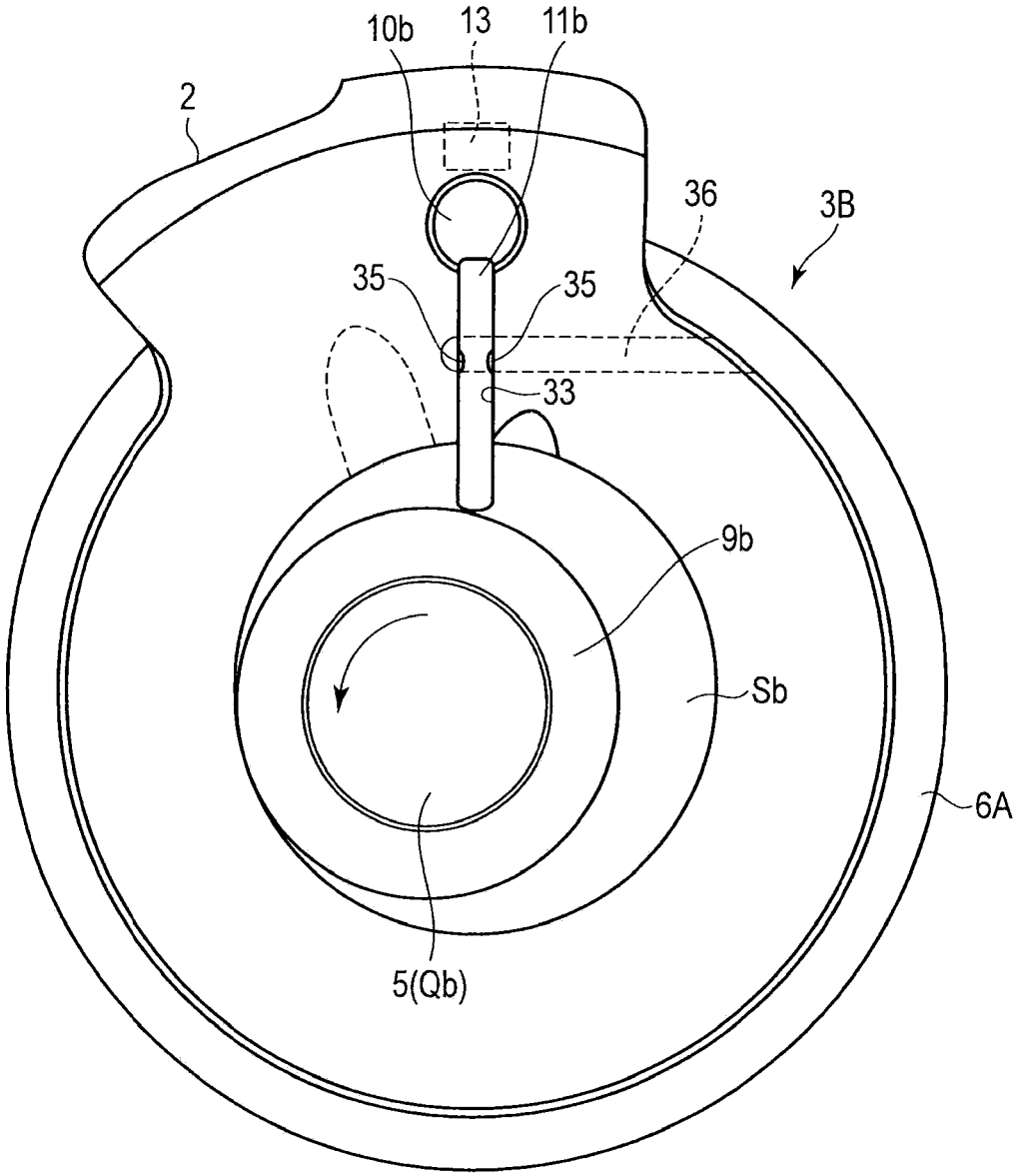
FIG. 3 is a top view illustrating a lubrication structure to a vane side surface according to the embodiment and along line A-A in FIG. 1.
Figure 4:
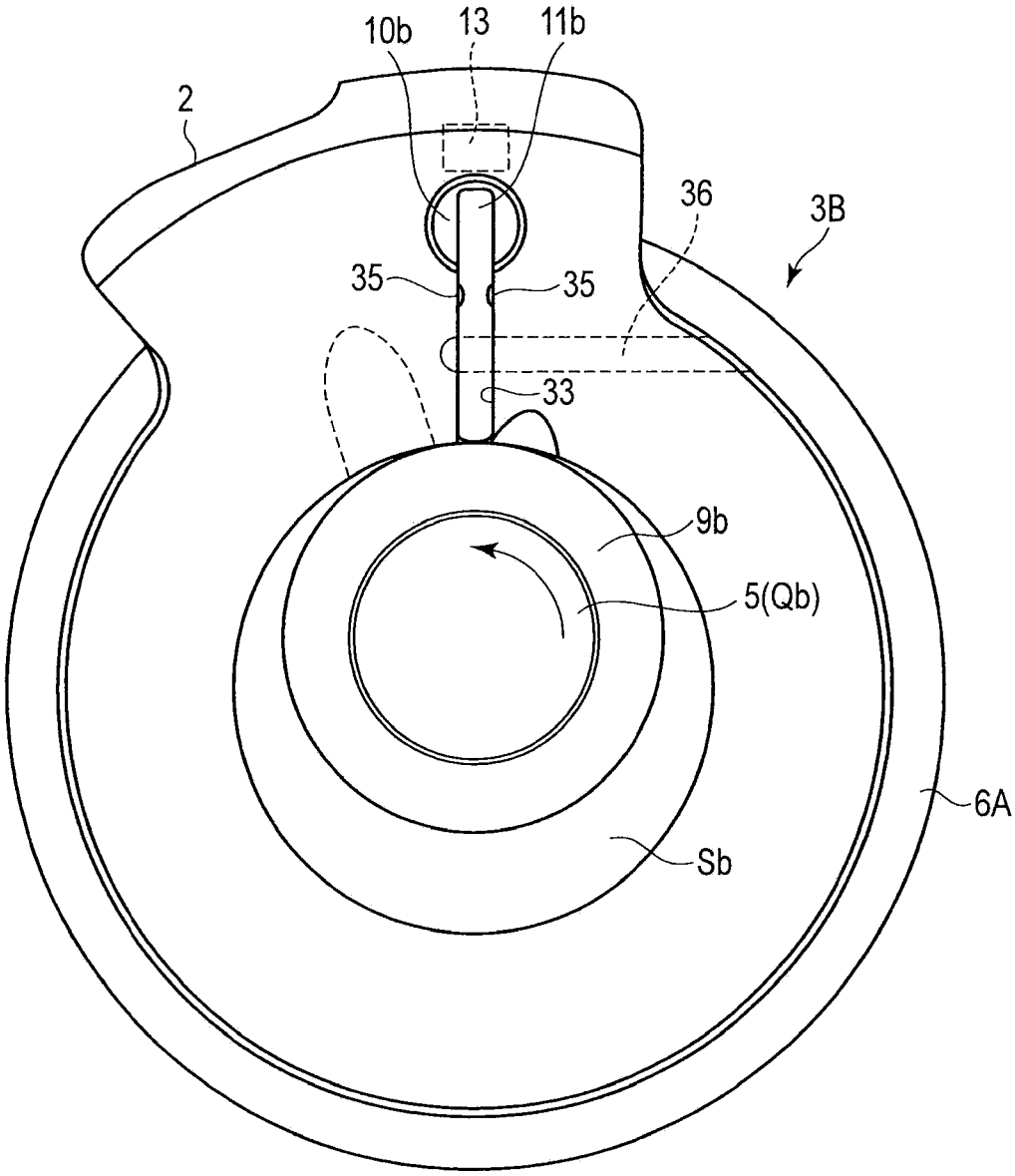
FIG. 4 is a top view illustrating the lubrication structure to the vane side surface according to the embodiment in a state different from the state in FIG. 3 and along line A-A in FIG. 1.

FIG. 2 is a longitudinal sectional view that enlarges a portion of the multi-cylinder rotary compressor R to illustrate a lubrication structure to the sliding contact surface of the second vane 11*b*, FIG. 3 is a top view along line A-A in FIG. 1, and FIG. 4 is a top view along line A-A in FIG. 1 in a state different from the state in FIG. 3.

With the reciprocation of the second vane 11*b*, both side surfaces thereof slidingly come into contact with a vane groove 33. Here, an oiling groove 35 is provided on both side surfaces, which are sliding contact surfaces of the second vane 11*b*. To give a description of the groove, the oiling groove 35 is a concave groove provided in a position a predetermined distance apart from the tip portion or the rear-end portion extending from an upper-end surface to a lower-end surface of the vane 11*b*.

On the other hand, a lubricating oil communication path 36 is provided on the undersurface of the intermediate partition plate 2 in contact with the upper surface of the second cylinder 6B. The lubricating oil communication path 36 is extended straight in a direction perpendicular to the longitudinal direction from the circumferential end surface of the intermediate partition plate 2 to the second vane 11*b* and the vane groove 33 and the tip portion of the communication path 36 crosses the upper-end surface of the vane lib and the upper end of the vane groove 33.

As described above, while high pressure is guided into the second vane rear chamber 10*b*, a low-pressure gas is guided into the second cylinder chamber Sb and if a differential pressure arises between the tip portion and the rear-end portion of the second vane 11*b*, the vane 11*b* receives a high-pressure back pressure and the tip portion thereof comes into contact with the circumferential wall of the second eccentric roller 9*b*.

Therefore, the second vane 11*b* reciprocates following an eccentric motion of the second eccentric roller 9*b*. If, as shown in FIG. 4, the position where the circumferential wall of the second eccentric roller 9*b* and the circumferential wall of the second cylinder chamber Sb come into contact and the position where the circumferential wall of the second eccentric roller 9*b* and the tip portion of the second vane 11*b* come into contact match, the tip portion of the second vane 11*b* dips most with respect to the second cylinder chamber Sb.

In this case, the second vane 11*b* is said to be in a "top dead center" position. When the axis of rotation 5 rotates counterclockwise, FIG. 3 shows a state in which the second vane 11*b* is 90° forward (rotated by 90° from the top dead center) from the position where the second vane 11*b* protrudes most to the second cylinder chamber Sb. The position where the second vane 11*b* protrudes most to the second cylinder chamber Sb is called a "bottom dead center" position.

As shown in FIG. 3, the oiling groove 35 on both side surfaces of the vane 11*b* is set to be opposite to and communicatively connected to the lubricating oil communication path 36 of the intermediate partition plate 2 in a position where the second vane 11*b* is rotated from the top dead center by 90°. It is needless to say that the oiling groove 35 is neither opposite to nor communicatively connected to the lubricating oil communication path 36 before the second vane 11*b* returns to the position again after going beyond the position.

When the second vane 11*b* is, as shown in FIG. 4, in the top dead center position, the oiling groove 35 on both side surfaces of the vane 11*b* is set to be opposite to portions other than the lubricating oil communication path 36 not to be communicatively connected to the lubricating oil communication path 36 and also to be positioned not to be communicatively connected to the second vane rear chamber 10*b*.

The intermediate partition plate 2 is naturally in a state of being soaked in lubricating oil of the oil stagnant portion 15 and thus, the lubricating oil penetrates from an open end on the circumferential end surface of the intermediate partition plate 2 of the lubricating oil communication path 36 provided here. The lubricating oil communication path 36 crosses the upper-end surface of the vane groove 33 and the second vane 11*b* and thus, lubricating oil wets a crossing portion.

When, as shown in FIG. 4, the second vane lib does not reciprocate and performs a resting cylinder operation in the second cylinder chamber Sb, the second vane 11*b* is in the top dead center position and lubricating oil guided into the lubricating oil communication path 36 wets only the crossing portion of the vane groove 33 and the second vane lib.

Actually, a certain amount of lubricating oil penetrates through a gap between the second vane lib and the vane groove 33, but the clearance is extremely small and also an oil film is formed thus, the amount of penetrating lubricating oil is also extremely small.

If the second vane lib reciprocates during the full-capacity operation described above, the oiling groove 35 provided in the second vane 11*b* is opposite to the lubricating oil communication path 36 in a portion rotated from the top dead center shown in FIG. 3 by 90° so that the oiling groove 35 is communicatively connected to the lubricating oil communication path 36. Lubricating oil stagnant in the lubricating oil communication path 36 is guided into the oiling groove 35 to be filled therewith.

The portion opposite to the vane groove 33 of the oiling groove 35 changes as the second vane 11*b* reciprocates and lubricating oil guided into the oiling groove 35 is thereby diffused to be applied in a wider area. In the end, the lubricating oil is supplied to the sliding contact surface between both side surfaces of the second vane 11*b* and both side surfaces of the vane groove 33 to ensure lubricity of the vane 11*b*.

Thus, even if the second vane chamber 10*b* has a sealed structure, a sufficient amount of lubricating oil can be supplied to the sliding contact surface between the second vane 11*b* and the vane groove 33 so that reliability can be improved and also a contribution to improvement in compression performance is made. Moreover, the refrigeration cycle apparatus includes the multi-cylinder rotary compressor R and so improvement in efficiency of the refrigeration cycle can be obtained.

Further, as shown in FIG. 4, the oiling groove 35 is provided in a position so as not to be communicatively connected to the second vane rear chamber 10*b* even if the second vane 11*b* is in the top dead center position. In the end, the oiling groove 35 of the second vane 11*b* is not communicatively connected to the second vane rear chamber 10*b* regardless of the position of the vane 11*b*.

If configured, for example, in a state in which the oiling groove 35 and the second vane rear chamber 10*b* are communicatively connected without making settings described above, lubricating oil stagnated in the oiling groove 35 escapes to the second vane rear chamber 10*b* and instead, a high-pressure gas filling the vane rear chamber 10*b* penetrates. Thus, it becomes difficult for lubricating oil to be present in the oiling groove 35 and oiling to the sliding contact surface with the second vane 11*b* will be insufficient.

The lubricating oil communication path 36 in the above embodiment is provided in a groove shape, but may be pores or recesses. In addition to the intermediate partition plate 2, a lubricating oil communication path in a similar shape may also be provided in the sub-bearing 8. That is, the lubricating oil communication path 36 is provided in a member in contact with an end surface perpendicular to the side surface of the second vane 11*b* and is not provided in the second cylinder 6B.

As described above, the undersurface opening portion of the second vane rear chamber 10*b* is blocked by the flange portion of the sub-bearing 8 and the blocking plate 12. More specifically, the external shape of the flange portion of the sub-bearing 8 is circular, an edge of the blocking plate 12 is formed in an arc shape to follow the external shape, circumferences of both are in a close contact state with no gaps present therebetween, and the second vane rear chamber 10*b* adopts a sealed structure.

Thus, as shown in FIG. 2, notching (interval portion) Qm may be provided in an edge portion in close contact with the flange portion of the sub-bearing 8 of the blocking plate 12 to oil the sliding contact surface of the second vane 11*b* to guide lubricating oil of the oil stagnant portion 15 to the oiling groove 35. The notching Qm is provided opposite to the lubricating oil communication path 36 provided in the intermediate partition plate 2 and achieves the same operation effect.

The notching Qm provided in the blocking plate 12 may be provided instead of the lubricating oil communication path 36 of the intermediate partition plate 2 or both may be provided without causing any trouble. In addition to providing the notching Qm in the blocking plate 12, the notching Qm may also be provided in the flange portion of the sub-bearing 8 or both of the blocking plate 12 and the flange portion of the sub-bearing 8 opposite to each other.

Further, the above embodiment of the present invention is not limited to the form as it is and structural elements thereof may be modified for embodiment in the operation stage without deviating from the scope thereof. Moreover, various inventions can be made by appropriately combining a plurality of structural elements disclosed in the above embodiment.

According to the present invention, there can be provided a multi-cylinder rotary compressor capable of providing high compression performance by ensuring smoothness of reciprocating movement of a vane on the side of performing a resting cylinder operation and a refrigeration cycle apparatus capable of improving the efficiency of the refrigeration cycle by including the multi-cylinder rotary compressor.

What is claimed is:

1. A multi-cylinder rotary compressor containing an electric motor unit and a compression mechanism unit in a well-closed container and having an oil stagnant portion that stagnates lubricating oil at an inner bottom of the well-closed container, wherein the compression mechanism unit includes a first cylinder and a second cylinder provided with an intermediate partition plate placed therebetween, having a cylinder chamber into which a low-pressure gas is introduced formed in respective inner diameter portions, and provided with vane rear chambers communicatively connected to the cylinder chambers via a vane groove, an axis of rotation having an eccentric portion contained in the respective cylinder chambers of the first cylinder and the second cylinder and connected to the electric motor unit, an eccentric roller fitted to an eccentric portion of the axis of rotation to eccentrically move inside each of the cylinder chambers with rotation of the axis of rotation, and a vane contained freely movably in the vane groove to partition the cylinder chamber while a tip portion thereof is in contact with a circumferential wall of the eccentric roller, one of the vane rear chambers provided in the first cylinder and the second cylinder includes an elastic body that brings the tip portion of the vane into contact with the circumferential wall of the eccentric roller by providing an elastic force to a rear-end portion of the vane to constantly cause compression operation in the cylinder chamber with the rotation of the axis of rotation, the other vane rear chamber has a sealed structure and includes a pressure switching unit that causes compression operation in the cylinder chamber with the rotation of the axis of rotation by guiding a portion of a high-pressure gas to provide high-pressure back pressure to the rear-end portion of the vane to bring the tip portion of the vane into contact with the circumferential wall of the eccentric roller or holds the tip portion of the vane separated from the circumferential wall of the eccentric roller by guiding the low-pressure gas to provide low-pressure back pressure to the rear-end portion of the vane, the vane receiving the back pressure due to the pressure switching unit is provided with an oiling groove on a side surface thereof, a component of the compression mechanism unit is provided with a lubricating oil communication path that communicatively connects the oiling groove and the oil stagnant portion, and the oiling groove is provided in a position opposite to a portion other than the lubricating oil communication path when the tip portion of the vane receiving the back pressure due to the pressure switching unit is in a top dead center position where the tip portion dips most from the cylinder chamber.

2. The multi-cylinder rotary compressor according to claim 1, wherein the component of the compression mechanism unit where the lubricating oil communication path is provided is provided in an intermediate partition plate that comes into contact with an end surface perpendicular to the side surface of the vane or a bearing fitting that pivotally supports the axis of rotation.

3. The multi-cylinder rotary compressor according to claim 2, wherein the vane rear chamber for which the pressure switching unit performs a switching operation has an opening surface blocked by the bearing fitting, a blocking plate, and the intermediate partition plate and the lubricating oil communication path is an interval portion provided between the bearing fitting and the blocking plate.

4. The multi-cylinder rotary compressor according to claim 1, wherein when the tip portion of the vane receiving the back pressure due to the pressure switching unit is in the top dead center position where the tip portion dips most from the cylinder chamber, the oiling groove is provided in the position opposite to the portion other than the vane rear chamber.

5. A refrigeration cycle apparatus, wherein a refrigeration cycle is configured by including the multi-cylinder rotary compressor according to claim 1, a condenser, an expansion apparatus, and an evaporator.

* * * * *